United States Patent [19]

Learn

[11] Patent Number: 4,723,663

[45] Date of Patent: Feb. 9, 1988

[54] MERCHANDISE DISPLAY SYSTEM

[75] Inventor: Craig A. Learn, Moorestown, N.J.

[73] Assignee: Quickie Manufacturing Corporation, Cinnaminson, N.J.

[21] Appl. No.: 942,189

[22] Filed: Dec. 16, 1986

[51] Int. Cl.[4] ..... A47F 7/00

[52] U.S. Cl. ..... 211/59.2; 211/66; 211/70.6; 211/94; 248/220.3; 248/220.4

[58] Field of Search ..... 211/59.2, 59.1, 108, 211/94, 65, 66, 70.6; 248/220.2, 220.3, 220.4, 221.1, 221.2

[56] References Cited

U.S. PATENT DOCUMENTS

| | | | |
|---|---|---|---|
| 2,313,245 | 3/1943 | Kent | 211/106 |
| 3,374,898 | 3/1968 | Karmin | 248/221.1 |
| 4,415,091 | 11/1983 | Wolff | 248/220.2 X |
| 4,467,925 | 8/1984 | Ratzloff et al. | 211/94 X |
| 4,501,369 | 2/1985 | Fox | 211/59.1 X |
| 4,576,291 | 3/1986 | Stein | 211/59.1 X |

OTHER PUBLICATIONS

Single Page Advertisement entitled "All The Best" by The Libman Company, Inc.

Four Page Publication entitled *Libman Rack Assembly Instructions.*

*Primary Examiner*—William H. Grieb

*Attorney, Agent, or Firm*—Steele, Gould & Fried

[57] ABSTRACT

A merchandise display system is disclosed which utilizes a vertical pegboard to which is attached a plurality of variously positioned horizontal tracks. The tracks include upper rails, lower rails and spaced pegboard securing fasteners and may be moved relative to the pegboard only by removing the track fasteners from pegboard holes and then reinserting the fasteners in other pegboard holes. A plurality of merchandise supporting hooks of suitable design to engage upon a track rail is provided to hang and to display mops, brooms, brushes and the like. The hooks are attached to the tracks intermediate the fasteners and are designed for horizontal sliding movement along the rails intermediate the fasteners. The hooks are designed to permit limited lateral movement relative to the stationary pegboard when either empty or when loaded with merchandise.

12 Claims, 13 Drawing Figures

MERCHANDISE DISPLAY SYSTEM

BACKGROUND OF THE INVENTION

1. Field of the Invention

The present invention relates generally to merchandise display systems, and more particularly, is directed to a Pegboard and hook type of display system that is capable of storing a wide variety of differently shaped products within a minimum, modular space in a manner to permit limited lateral adjustment of the merchandise without requiring the removal and replacement of the hooks.

2. Discussion of the Prior Art

Numerous display systems employing Pegboards have been developed by prior workers in the art for hanging and displaying great varieties of goods. The prior art display systems have incorporated conventional pegboards, that is, a planar board which is usually composed of one-eighth inch or larger hardboard and which has been drilled to provide spaced horizontal and vertical rows of openings generally positioned at one inch intervals. Cooperating bent wire hooks have been designed and have been provided for removable connection to the pegboard by applying end portios of the hooks within the pegboard openings to thereby provide a hanging attachment of predetermined configuration for hanging and displaying the various items to be stored and vended. The prior art hooks were formed in various sizes and configurations as necessary for hanging and display of a variety of particularly sized and shaped products.

Most of the known types of prior display systems were more or less universal in application and the variously shaped hooks could be randomly applied to the Pegboard by the store or shop owner to meet his own requirements in a manner to hang and display the maximum amount of merchandise in a given space and in a pleasing manner. Other, more comprehensive systems have been developed to display complete lines of similar or related merchandise, for example, plumbing parts, electrical parts, etc. In a merchandise display system designed to display and vend a plurality of cleaning products, dustpans and the like, the Libman Co., Inc., Arcola, Ill. has designed a plurality of particularly configured wire hooks for attachment to a Pegboard in a manner to hang pluralities of brooms, mops, brushes, dustpans and the like of varying sizes and shapes.

So far as is known to the present applicant, all of the previously designed and utilized Pegboard hanging systems included means for easily affixing the hooks to the Pegboards. Additionally, all required the hooks to be completely separated from the Pegboard and then to be reinstalled when it was desired to laterally move one or more of the items of hanging merchandise. The necessity for removal and replacement of the hooks, together with all of the goods stored upon the hooks, even when only minor modifications to the display were contempted, has resulted in a considerable chore that is both time consuming and bothersome. On occasion when it became desirable to move the items to be displayed in order to accommodate new merchandise or differently configured merchandise, most often it was necessary to completely disassemble the hanging display and then to reassemble the hooks on the Pegboard in a location and pattern to hold the new merchandise. So far as is known, no system heretofore developed has included design features which would permit a store owner to laterally move items of merchandise relative to the Pegboard without first removing and repositioning the hooks.

SUMMARY OF THE INVENTION

The present invention relates generally to the field of store merchandise displays, and more particularly, is directed to a merchandise display system suitable for vending mops, brushes, brooms and the like in a compact, modular area and in a manner to permit limited lateral adjustment of the merchandise and the supporting hooks relative to the stationary Pegboard.

The merchandise display system of the present invention incorporates a known type of planar Pegboard which is vertically supported in well-known manner by a sturdy, floor contacting base. A plurality of novel, horizontal tracks comprising vertically spaced horizontal rails and integral Pegboard securing fasteners are provided for horizontal placement upon the Pegboard at various vertically and transversely spaced locations. Each track includes at least an upper rail and a lower rail for removable engagement and support of a plurality of variously shaped, product supporting hooks.

Each of the hooks comprises an elongated body section which projects outwardly or forwardly from the vertical Pegboard for product support and product display purposes. Each hook terminates at its Pegboard end in a bent support of size and configuration to engage upon either or both of the upper and lower rails of a Pegboard supported track. Small product display hooks are provided and are equipped with bent latches of size to engage over and under the rails of a track. Larger mop and broom supporting hooks have been designed and these hooks terminate inwardly in pairs of upper and lower bent catches for reversible engagement over the top rail of a track. These hooks are especially designed to permit optional top or bottom installation by simply rotation the hook through one hundred and eighty degrees.

Each track is characterized by at least one left end and one right end Pegboard engaging fastener or projection and a horizontal space defined between the end projections. The projections terminate in bent ends of suitable configuration to engage the Pegboard by inserting through a Pegboard opening. The merchandise carrying hooks are intended for and are particularly designed to interact with the horizontal rails of the tracks in a manner to permit lateral or transverse movement of the hooks along the tracks intermediate the Pegboard fasteners without moving the tracks. Accordingly, when it is desired to laterally move one or more of the merchandise carrying hooks relative to the Pegboard, it is not necessary to remove and replace the tracks, but rather, all that is required is to simply push or urge one or more of the hooks laterally along its supporting track to the desired laterally adjusted position.

Hooks of various configurations can be designed for movable support from a track with their respective body sections or projecting portions particularly configured to carry a plurality of a desired product, for example, mops, brooms, brushes, dustpans and the like. It will be appreciated that when differently configured items of merchandise are to be displayed, other cooperatively configured hooks can be designed to support such merchandise provided that the Pegboard ends of the new hooks are similarly configured for engagement and laterally sliding arrangement upon one of the Pegboard associated tracks.

It is therefore an object of the present invention to provide an improved merchandise display system of the type set forth.

It is another object of the present invention to provide a novel merchandise display system of the type comprising a vertical Pegboard including track means removably affixed to the pegboard of predetermined locations and hook means interconnectable with the track means in a manner to facilitate limited transverse movement of the hook means with the display merchandise relative to the Pegboard.

It is another object of the present invention to provide a novel merchandise display system for use with a vertical Pegboard comprising a plurality of merchandise carrying hooks and a plurality of horizontal tracks, the tracks including pegboard engaging projections, a plurality of configured hooks each having a body portion projecting from the Pegboard, each track including end fasteners having bent ends to support the track upon the Pegboard, each hook comprising an elongated body and a track contacting catch, the track contacting catches being laterally slidable along the tracks to permit limited transverse adjustment of the hooks relative to the Pegboard.

It is another object of the present invention to provide a novel merchandise display system comprising generally a vertically supported Pegboard, a plurality of horizontal tracks removably engageable upon the Pegboard, each track comprising an upper rail and a lower rail, a plurality of broom hooks engageable upon and laterally slidable along a track, a plurality of mop hooks engageable on and laterally slidable along a track and a plurality of small item hooks engageable upon and laterally slidable along a track whereby a modular, compact and easily adjustable display unit can be provided.

It is another object of the present invention to provide a novel merchandise display system that is rugged in construction, horizontally adjustable in nature and trouble-free when in use.

Other objects and a fuller understanding of the invention will be had by referring to the following description and claims of a preferred embodiment, taken in conjuction with the accompanying drawings, wherein like reference characters refer to similar parts throughout the several views and in which:

DESCRIPTION OF THE PREFERRED EMBODIMENT OF THE INVENTION

Figure 1:
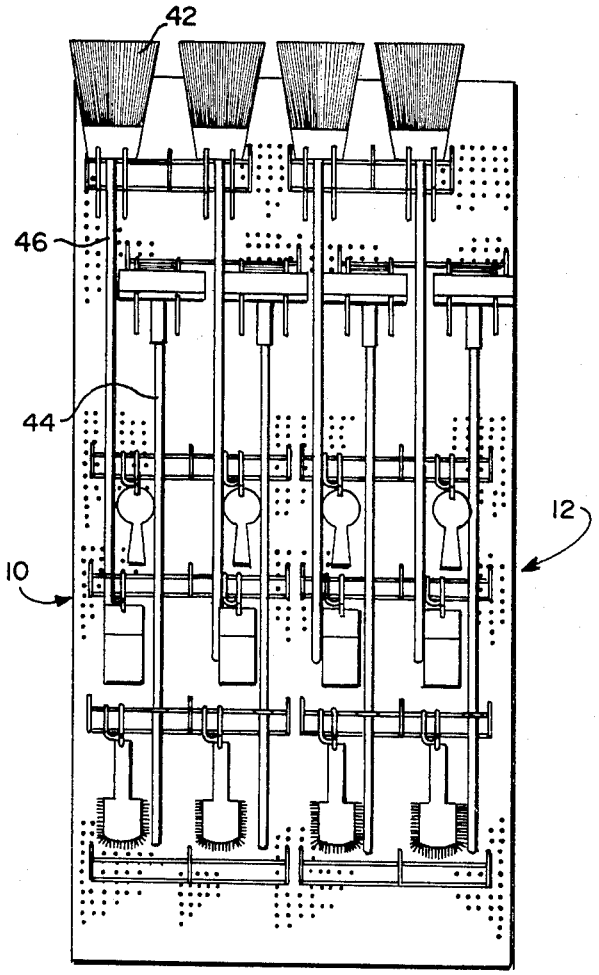
FIG. 1 is an elevational view of a Pegboard merchandise display unit showing merchandise displayed and secured upon the Pegboard in accordance with the teachings of the present invention.

Although specific terms are used in the following description for the sake of clarity, these terms are intended to refer only to the particular structure of the invention selected for illustration in the drawings, and are not intended to define or limit the scope of the invention.

Figure 2:
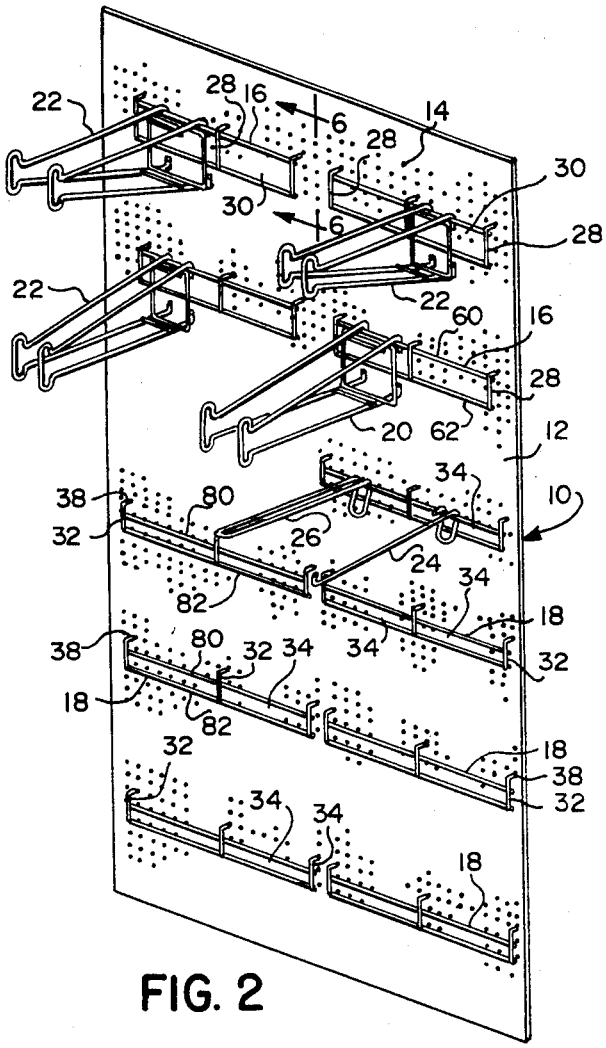
FIG. 2 is a perspective veiw showing a plurality of merchandise supporting hooks and horizontal tracks installed upon a Pegboard.

Referring now to the drawings, there is shown in FIGS. 1 and 2 a merchandise display system generally designated 10 which comprises essentially a vertical support in the nature of a conventional Pegboard 12 having a plurality of holes 14 arranged in spaced vertical and horizontal rows provided therein. In the present application, it is preferred to employ the type of Pegboard wherein the vertical and horizontal rows of holes are spaced at one inch intervals. As shown, a plurality of wide or large horizontal tracks 16 are removably affixed to the pegboard 12 in the upper portions thereof. A plurality of small or narrow tracks 18 are removably secured to the Pegboard 12 in spaced intervals below the wide horizontal tracks 16.

Figure 4:
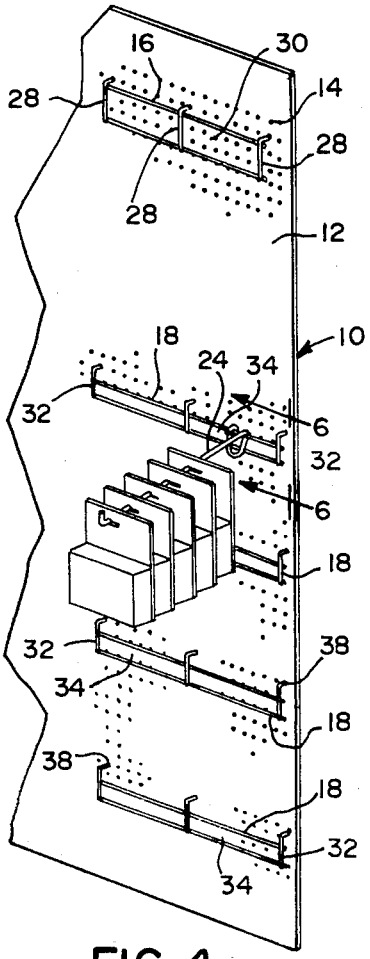
FIG. 4 is an enlarged, partial, perspective view showing a plurality of tracks in place on a Pegboard and a plurality of small packages supported on a small item hook.
Figure 12:
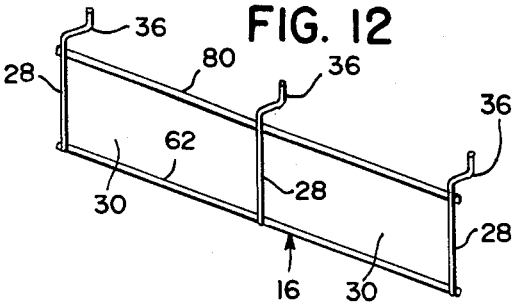
FIG. 12 is an enlarged, perspective view of a wide track.
Figure 5:
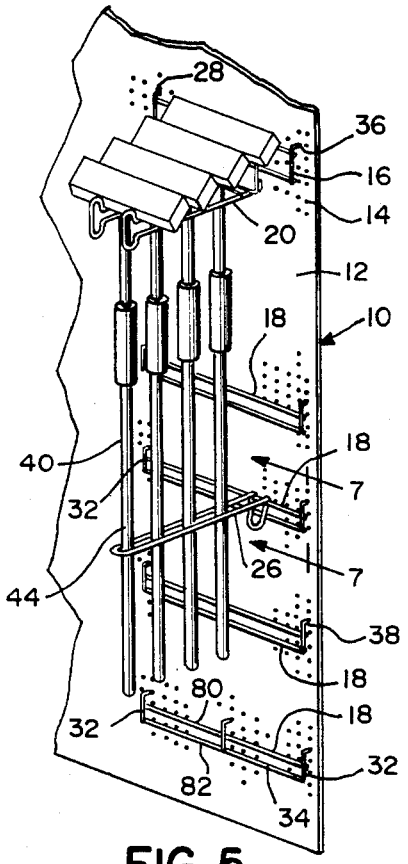
FIG. 5 is an enlarged, partial, perspective view showing a plurality of tracks in place on a Pegboard and a plurality of mops carried upon a mop supporting hook.
Figure 10:
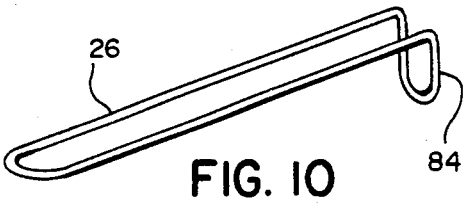
FIG. 10 is an enlarged, perspective view of a handle hook.
Figure 11:
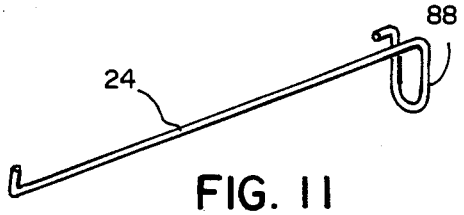
FIG. 11 is an enlarged, perspective view of a small item hook.

The horizontal tracks 16, 18 each include two or more horizontally spaced fasteners or Pegboard engaging projections 28 which define therebetween relatively wide horizontal spaces 30. One or more mop hooks 20 and one or more broom hooks 22 are releasably secured to the wide horizontal tracks 16 in overfitting relationship to a horizontal space 30. It is an important feature of this invention that the mop and broom hooks 20, 22 have limited horizontl movement along a track 16 intermediate horizontally spaced pairs of Pegboard engaging fasteners or projections 28. The narrow or small horizontal tracks 18 are similar in design and are similarly equipped with Pegboard engaging fasteners or projections 32 which preferably are endwardly positioned as shown. If desired, and if necessary due to the length of a track, an additional fastener 32 can be provided intermediate the end fasteners 32 to provide a stable and sturdy construction. As shown in FIGS. 2, 4 and 5, it will be noted that one or more small item hooks 24 and one or more handle hooks 26 can be engaged upon the small tracks 18 at the intermediate spaces 34 thereof so as to facilitate hook engagement in a manner to allow limited, horizontal sliding movement of a hook 24, 26 relative to its supporting small track 18.

Figure 3:
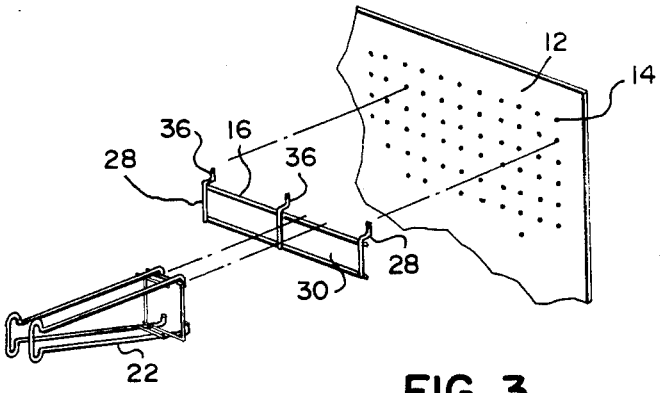
FIG. 3 is an exploded, partial, perspective view of a hook, a track and a fragment of a Pegboard.

Referring now to FIGS. 3, 4, and 5, it will be observed that each wide and narrow horizontal track 16, 18 secures to the Pegboard 12 in any predetermined location by inserting the respecitve fastener bent ends 36, 38 into selected, horizontally spaced pairs of Pegboard openings 14. In the illustrated embodiment, two rows of large tracks 16 are vertically spaced in the upper portion of the Pegboard 12 and at least four horizontally spaced small tracks 18 are secured to the pegboard below the large tracks 16. Of course, the number and placement of the large and small horizontal tracks 16, 18 can be adjusted and changed as necessary or desired to hang and display particularly sized and shaped merchandise. As shown, it is preferred to hang elongated articles such as mops 40 and brooms 42 near the top of the Pegboard to thereby provide sufficient hanging space to accommodate the handles 44, 46 of the mops and brooms. As shown, the large mop hooks 20 and broom hooks 22 are carried upon the large horizontal tracks 16. The small item hooks 24 and handle hooks 26 are adjustably supported from the smaller horizontal tracks 18.

Figure 8:
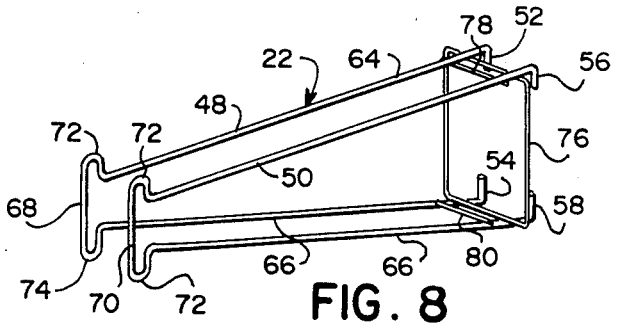
FIG. 8 is an enlarged, perspective view of a broom hook.
Figure 9:
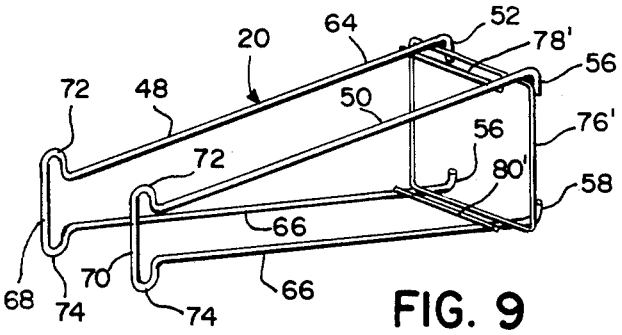
FIG. 9 is an enlarged, perspective view of a mop hook.

As illustrated in FIGS. 8 and 9, the broom hooks 22 are formed substantially identically to the mop hooks 20 with the exception that the broom hooks are somewhat narrower in configuration to more snugly accommodate the narrower silhouette of a broom 42. The mops 40 generally include some type of a wringing apparatus which requires the wider spread between the arms as provided in the mop hooks 20 for easy placement and removable purposes when storing or vending such a product. The mop and broom hooks 20, 22 are similar in design and in concept and each comprises a pair of horizontally spaced arms 48, 50 of generally trapezoidal configuration. The arms 48, 50 terminate at their Pegboard ends in respective upper and lower, similar, facing, bent catches 52, 54 and 56, 58. The bent catches are so positioned and so configured as to permit easy attachment of a hook 20 or 22 to a large horizontal track 16 by engaging horizontally spaced pairs of catches 52, 56 upon the upper rail 60 of a large track 16.

The respective pairs of catches 52, 56 and 54, 58 are substantially identical in configuration and in use whereby either of the hooks 20, 22 can be positioned upon the Pegboard 12 in either of two orientations which are one hundred eighty degrees apart. It is noteworthy that each of the arms 48, 50 of the hooks 20, 22 is formed with a downwardly inclined member 64 and an integrally connected horizontal member 66. As shown, when the horizontal members 66 of the hooks 20, 22 are positioned upwardly on a horizontal track 16, the supported mops or brooms will be arranged in horizontal orientation in a manner which is generally preferable for tyop positioned mops and brooms. When the inclined members 64 of the hooks 20, 22 are upwardly positioned relative to a large track 16, then the supported mops or brooms will be carried in a forwardly inclined or slanted orientation. Accordingly, when a front positioned mop 40 or broom 42 is removed from a respective mop hook 20 or broom hook 22, the remaining mops or brooms supported upon the inclined members 64 will slide forwardly automatically to thereby provide a continuous forward presentation of the remaining stored mops or brooms. The hooks 20, 22, when the inclined members 64 are orientated upwardly, thereby provide automatic forwardly inclined movement of the mops and brooms 40, 42 as they are vended from the rearward positions as indicated.

Still referring to FIG. 8 and 9, the inclined members 64 and horizontal members 66 of each hook arm 48, 50 forwardly join at a vertical web 68, 70 through bent upper and lower retainers 72, 74, which retainers serve to prevent unintentional disassociation of a mop or broom 40, 42 from its supporting mop hook 20 or broom hook 22. At the ends of the arms opposite the webs 68, 70, the arms 48, 50 are each strengthened and joined by a generally rectangular frame 76, 76', which frame can be spot welded or otherwise secured to the respective inclined and horizontal members 64, 66 of each arm 48, 50. If necessary or desirable, additional upper and lower strengthening struts 78, 80, 78', 80' may be transversely secured near the respective Pegboard ends of the arms 48, 50.

Figure 6:
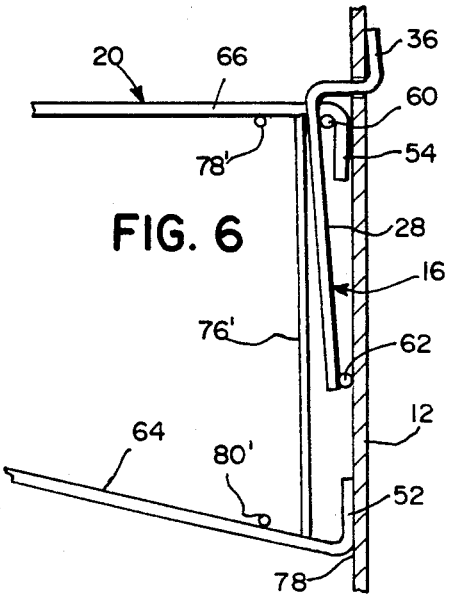
FIG. 6 is an enlarged, partial, cross sectional view taken along line 6—6 on FIG. 4, looking in the direction of the arrows.

As best seen in FIG. 6, the large horizontal track 16 is stationarily secured to the Pegboard 12 by inserting the bent ends 36 of the pegboard engaging projections 28 through appropriate Pegboard holes or openings 14. As shown, the lower rail 62 of the track 16 will be urged directly against the front face 78 of the Pegboard 12 and the bent end 36 is so condigured as to space the upper rail 60 sufficiently forwardly of the front pegboard face 78 to permit the bent catches 52, 56 or 54, 58 of a hook 20, 22 to engage upon the upper rail 60 by inserting downwardly through the space thus provided. When it is desired to hang the mop hooks 20 and broom hooks 22 with the horizontal members 64 facing upwardly, the respective horizontal member hooks 54, 58 should be engaged over the upper track rail 60. When it is desired to hang the inclined members 64 upwardly to thereby facilitate forward, downwardly inclined movement of the supported mops or brooms, then the respective bent catches 52, 56 should be engaged over the upper track rail 60. Thus is it seen that the system provides an easy interchangability between the upward position of the horizontal members 66 and the inclined member 64 as may be desired by the installer. As above mentioned, further adaptability is provided by the inherent ability of a mop hook 20 or a broom hook 22 to be urged laterally or transversely along the horizontal spaces 30 provided intermediate respective pairs of Pegboard engaging projections 28.

Figure 7:
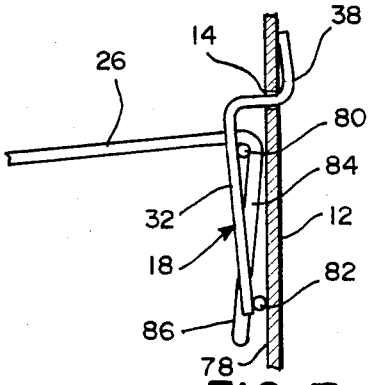
FIG. 7 is an enlarged, partial, cross sectional view taken along line 7—7 on FIG. 5, looking in the direction of the arrows.
Figure 13:
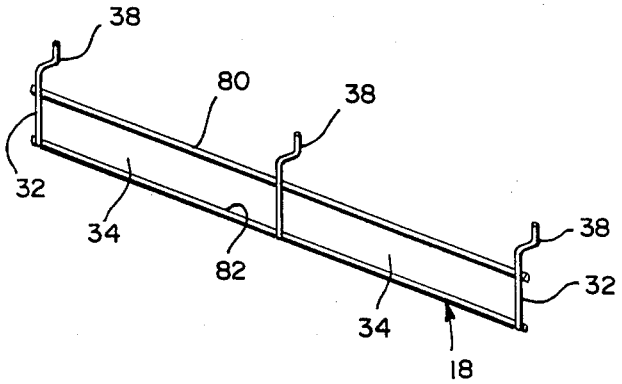
FIG. 13 is an enlarged, perspective view of a narrow track.

As illustrated in FIGS. 5, 7, 10 and 13, the narrow horizontal tracks 18 are conventionally secured to the Pegboard 12 by inserting the respective bent ends 38 of the Pegboard engaging projections 32 through respective, horizontally spaced Pegboard openings 14 at the desired vertically and horizontally adjusted locations. As best seen in FIG. 7, the lower rail 82 of the track 18 will rest directly upon the front surface 78 of the pegboard 12. The bent end 38 of the small horizontal track 18 is so configured as to allow the upper rail 80 to be spaced slightly forwardly of the Pegboard front surface 78 to thereby define a space therebetween. The bent end 84 of a handle hook 26 can be inserted downwardly into the space between the upper rail 80 and the front of the Pegboard 12 and is positioned so that the lower end 86 of the bend 84 is positioned in front of the lower track rail 82, thereby providing an easily assembled and extremely sturdy handle hook supporting engagement.

As above set forth, it is noteworthy that the handle hook 26 can be horizontally adjusted within the horizontal space 34 defined between adjacent Pegboard engaging projections 32 without the need to remove the horizontal track 18 from engagement with the Pegboard 12. It will further be noted that the handle hook 26 can be horizontally moved relative to the stationary small track 18 either when empty as illustrated in FIG. 2 or with the mop or broom handles 44, 46 positioned therewithin in the manner illustrated in FIG. 5. Similarly, a small item hook 24 can be supported upon a narrow track 18 in the same manner by positioning the small item bent end 88 under the upper rail 80 and over the lower rail 82 in the same manner as illustrated in FIG. 7.

In use, a plurality of large horizontal tracks 16 and small horizontal tracks 18 are secured upon a Pegboard 12 in predetermined desired locations in the manner illustrated in FIGS. 1, 2, 4 and 5. With the tracks 16, 18 properly secured in place, then any desired numbers of mop hooks 20 and broom hooks 22 can be positioned upon and slidably engaged over the upper rails 60 of the large tracks 16 in predetermined locations. If it becomes necessary or desirable to move the mop hooks 20 or broom hooks 22 relative to the large horizontal tracks 16, lateral movement can readily be accomplished by urging the hooks transversely along the horizontal spaces 30 provided between adjacent Pegboard engaging projections or track fasteners 28.

Similarly, a predetermined desired number of small item hooks 24 and handle hooks 26 can be slidingly secured to the small horizontal tracks 18 by positioning the respective bnet ends 84, 88 behind the narrow track upper rails 80 and in front of the lower rails 82 in the manner illustrated in FIG. 7. Hereagain, it is noteworthy that the small item hooks 24 and handle hooks 26 are easily laterally adjusted by moving the respective hooks transversely along the intermediate spaced 34 provided between adjacent Pegboard engaging projections or track fasteners 32.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A merchandise display system for use with a Pegboard having pluralities of horizontally and vertically spaced rows of openings comprising track means including at least a pair of spaced Pegboard engaging projections to secure to the Pegboard at spaced openings thereof; and hooks means removably connected to the tracks means to display the merchandise, the hook means comprising catch means to contact the track means intermediate the said pair of Pegboard engaging projections, the catch means being movable along the track means without disconnecting the hook means from the track means, the hook means further comprising an elongated merchandise supporting body extending from the catch means, the body comprising a pair of spaced arms, the arms comprising an upper member, a lower member and a web interconnecting the upper and lower members.

2. The merchandise display system of claim 1 wherein the track means comprises an upper rail, the upper rail being secured at spaced intervals to the said Pegboard engaging projections.

3. The merchandise display system of claim 2 wherein the track means comprise a lower rail spaced below the upper rail, the lower rail being secured at spaced intervals to the said Pegboard engaging projections.

4. The merchandise display system of claim 2 wherein the catch means contacts the upper rail and is slidable along the upper rail intermediate the Pegboard engaging projections.

5. The merchandise display system of claim 1 wherein the upper and lower members respectively integrally extend from a catch means.

6. The merchandise display system of claim 1 wherein the upper and lower members are so angularly oriented relative to the catch means that one member projects outwardly at right angles to the Pegboard and the other member projects at an angle of other than ninety degrees from the plane of the Pegboard when the hook means is connected to the track means.

7. The merchandise display system of claim 6 wherein the upper member is the one member that projects at right angles to the Pegboard.

8. The merchandise display system of claim 6 wherein the lower member is the one member that projects at right angles to the Pegboard.

9. The merchandise display system of claim 1 wherein the U-shaped bend engages the track means at the said upper rail intermediate the upper rail and the Pegboard and at the lower rail by contacting the lower rail without touching the Pegboard.

10. The method of displaying merchandise from a Pegboard of the type having pluralities of spaced rows of openings comprising the steps of securing a horizontal track to the Pegboard by inserting at least a pair of Pegboard engaging projections into a pair of spaced Pegboard openings;

connecting at least one merchandise supporting hook to the horizontal track in a manner that will permit lateral movement of the hook relative to the Pegboard along the track without moving the track, wherein the horizontal track comprises an upper rail and a lower rail and the hook comprises a bent end and wherein the connecting comprises engaging the said bent end with both the upper rail and the lower rail;

displaying the merchandise on the hook in a manner whereby the merchandise can be laterally moved when the hook is laterally moved without moving the track, providing an intermediate space between the Pegboard engaging projections and connecting the hook to the track at the said intermediate space; and, moving the hook horizontally across at least a portion of the intermediate space.

11. The method of claim 10 wherein the upper and lower rails have a surface facing toward the Pegboard and a surface facing away from the Pegboard and wherein the engaging comprises contacting the surface of the upper rail that faces toward the Pegboard with the bent end.

12. The method of claim 11 wherein the engaging further comprises contacting the surface of the lower rail that faces away from the Pegboard with the said bent end.

* * * * *